US007314252B2

(12) United States Patent
Ohliv et al.

(10) Patent No.: US 7,314,252 B2
(45) Date of Patent: Jan. 1, 2008

(54) CHAIR SUPPORTED BY A PLURALITY OF LEGS

(75) Inventors: Bengt Ohliv, Växjö (SE); Rolf Johansson, Älmhult (SE)

(73) Assignee: Inter IKEA Systems, B.V., Delft (NL)

( * ) Notice: Subject to any disclaimer, the term of this patent is extended or adjusted under 35 U.S.C. 154(b) by 0 days.

(21) Appl. No.: 11/271,272

(22) Filed: Nov. 10, 2005

(65) Prior Publication Data

US 2006/0208553 A1 Sep. 21, 2006

(30) Foreign Application Priority Data

Nov. 12, 2004 (DK) ..... PA 2004 01745

(51) Int. Cl.
*A47C 31/00* (2006.01)
*A47B 91/00* (2006.01)

(52) U.S. Cl. ..... 297/463.1; 248/188.7

(58) Field of Classification Search ..... 297/440.24, 297/463.1, 445.1; 248/188, 188.7; 403/109.3, 403/DIG. 11, 329, 326
See application file for complete search history.

(56) References Cited

U.S. PATENT DOCUMENTS 2,210,047 A * 8/1940 Stieglitz ..... 108/156
4,053,129 A * 10/1977 Graff ..... 248/188.7
4,117,784 A * 10/1978 Piretti ..... 108/150
4,588,227 A * 5/1986 Austin ..... 297/440.24
4,653,710 A * 3/1987 Dickison ..... 248/188.7
5,437,425 A * 8/1995 Hou ..... 248/188.6
5,501,419 A * 3/1996 Huang ..... 248/188.7

FOREIGN PATENT DOCUMENTS

GB 2123687 * 2/1984

* cited by examiner

*Primary Examiner*—Milton Nelson, Jr.
(74) *Attorney, Agent, or Firm*—Cooper & Dunham LLP

(57) ABSTRACT

A chair including a central, substantially vertical supporting member provided with a seat at the top, where the supporting member at the bottom end thereof or adjacent thereto is supported by a plurality of legs. Each leg is substantially horizontal, and one end of each leg is inserted into an opening in a projecting portion of a star-shaped member positioned at the bottom of the supporting member, the one end of each leg being secured in the opening by way of a snap effect and wherein each leg is secured to its respective projecting portion of the star-shaped member by a projecting, rounded guide member positioned at one end of the leg, the guide member being adapted to engage a recess in the under side of the projecting portion of the star-shaped member.

16 Claims, 5 Drawing Sheets

CHAIR SUPPORTED BY A PLURALITY OF LEGS

Figure 1:
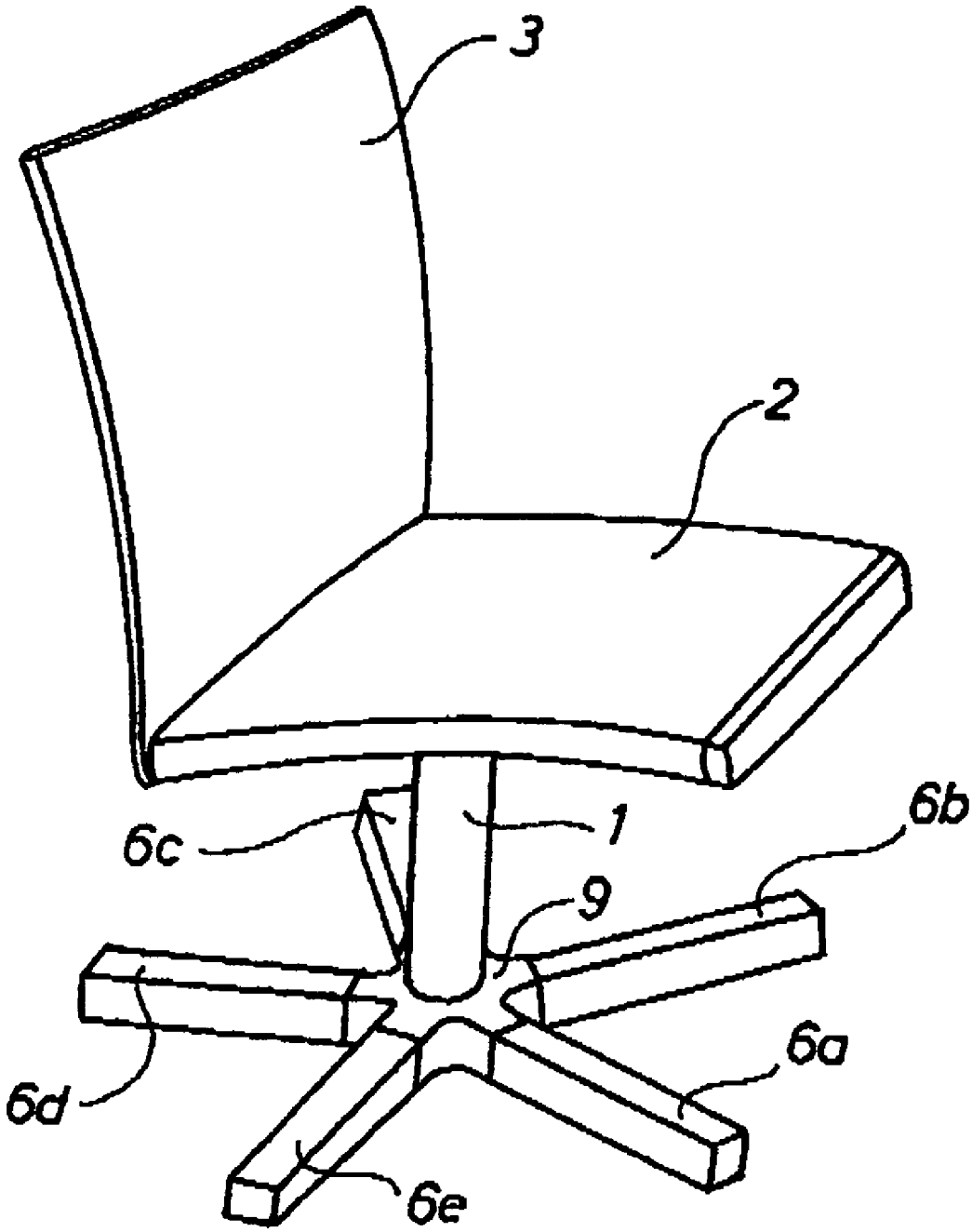

The invention relates to a chair including a central, substantially vertical supporting member provided with a seat at the top, said seat optionally including a back rest, and where said supporting member at the bottom end thereof or adjacent thereto is supported by a plurality of legs.

A chair of the above type is known where a seat and a back rest are mounted at the top portion of the supporting member, and where a ring is mounted on the lower end of said supporting member, the legs of the chair extending from said ring and being formed integral with the ring. As the legs are permanently positioned radially on the ring, the ring and the legs take up much space compared to the remaining chair.

The object of the present invention is to provide a chair of the above type, said chair allowing the lower parts of the chair to be easily disassembled so as to reduce the "volume" of the chair, when said chair is to be stored, said chair also being easily assembled for use.

The chair according to the invention is characterised in that each leg is substantially horizontal, and that one end of each leg is inserted into an opening in a projecting portion of a star-shaped member positioned at the bottom of the supporting member, said one end of each leg being secured in the opening by way of a snap effect As a result, the legs of the chair can be easily connected with the supporting member, i.e. by inserting one end of each leg in an opening in a projecting portion of the star-shaped member. The legs are also easily disassembled by way of pulling them out of said openings.

In addition, according to the invention, each leg may be secured to its respective projecting portion of the star-shaped member by means of a projecting, rounded guide member positioned at one end of said leg, said guide member being adapted to engage a recess in the under side of the projecting portion of the star-shaped member, said recess preferably being rounded. In this manner, a particularly reliable securing is obtained of the end of each leg in its respective projecting portion of the star-shaped member.

Furthermore, according to the invention, a locking hook may be provided on the end of each leg to be secured to the supporting member, said locking hook preferably being resilient and adapted to cooperate with a second recess in the projecting portion of the star-shaped member, whereby a particularly reliable securing of the each leg is obtained.

According to the invention, the guide member of each leg may be substantially annular and preferably present a horizontal axis, thereby allowing one end of the leg to be particularly easily mounted, as the guide member is particularly easily received by said recess when the leg is to be mounted.

Furthermore, according to the invention, the locking hook may be shaped so as to correspond to the upper half of a horizontal arrow with a strong shaft As a result, the locking hook stabilises the leg in relation to the projecting portion of the star-shaped member in a particularly effective manner.

According to the invention, an abutment face may be provided at the back of the locking hook, said abutment face being adapted to cooperate with a corresponding abutment face on the projecting portion of the star-shaped member. In this way, a particularly reliable securing of the leg in the recess is obtained.

Furthermore, according to the invention, the recess in the projecting portion of the star-shaped member may present a portion of an elliptical face, thus allowing the end of the leg to be particularly easily adjusted in the recess.

In addition, according to the invention, a channel may be provided in the projecting portion of the star-shaped member and opposite the head of the locking hook, said channel extending from the outer side of the projecting portion and to the head of the locking hook. In this way, the user can release the coupling in a particularly easy way, i.e. by inserting a stick into said channel until said stick hits the locking hook, and then by pressing the locking hook free of the engagement with the projecting portion of the star-shaped member.

According to the invention, the projecting portions of the star-shaped member may be bent slightly downwards, preferably 10 to 30°, and each leg may be substantially rectilinear and include a horizontally positioned supporting face at the distal end thereof. As a result, only the distal end of each leg abuts the supporting face of the chair, and the legs—when these are resilient—can provide the chair with a slightly resilient support.

Finally, according to the invention, each leg may be secured to its respective projecting portion of the star-shaped member by inserting the locking hook through an opening in a substantially vertically positioned auxiliary rib in said projecting portion of the star-shaped member, and by the leg including two supporting faces optionally integrally formed and abutting the lower end of the auxiliary rib and a supporting rib positioned in front of said auxiliary rib, respectively. This results in a particularly reliable locking of the respective leg to the respective projecting portion of the star-shaped member, because the locking hook is particularly reliably secured to said projecting portion on the star-shaped member as said hook is guided through said opening in the auxiliary rib.

Figure 2:
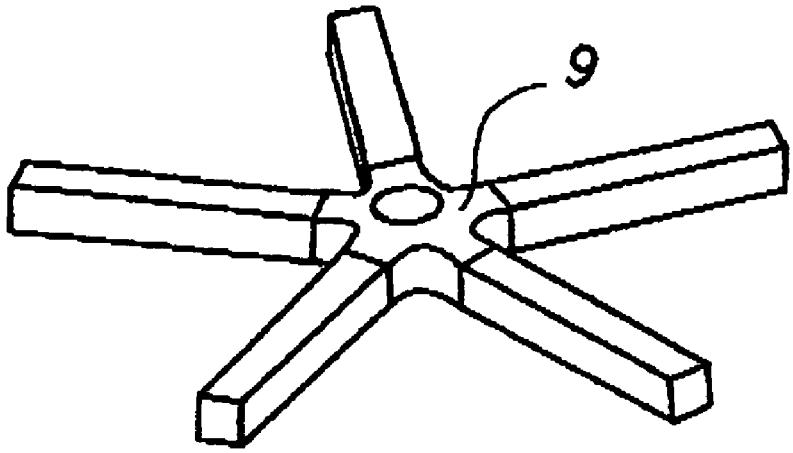
Figure 3:
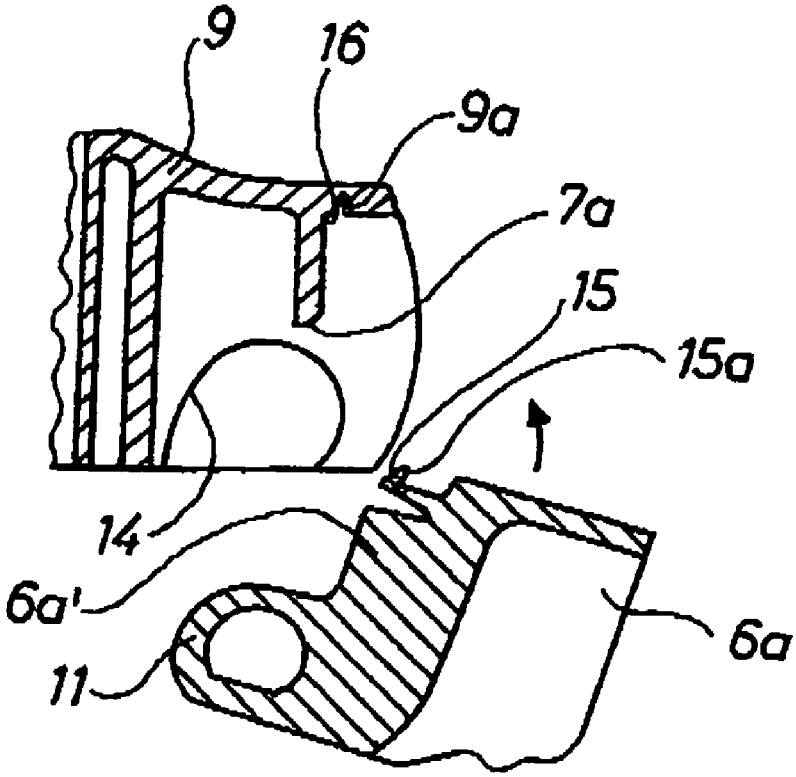
Figure 4:
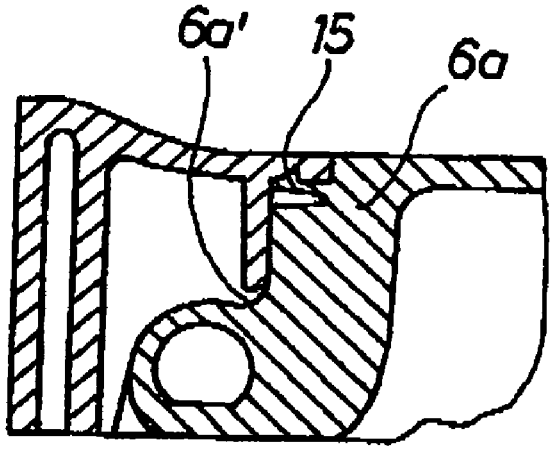
Figure 5:
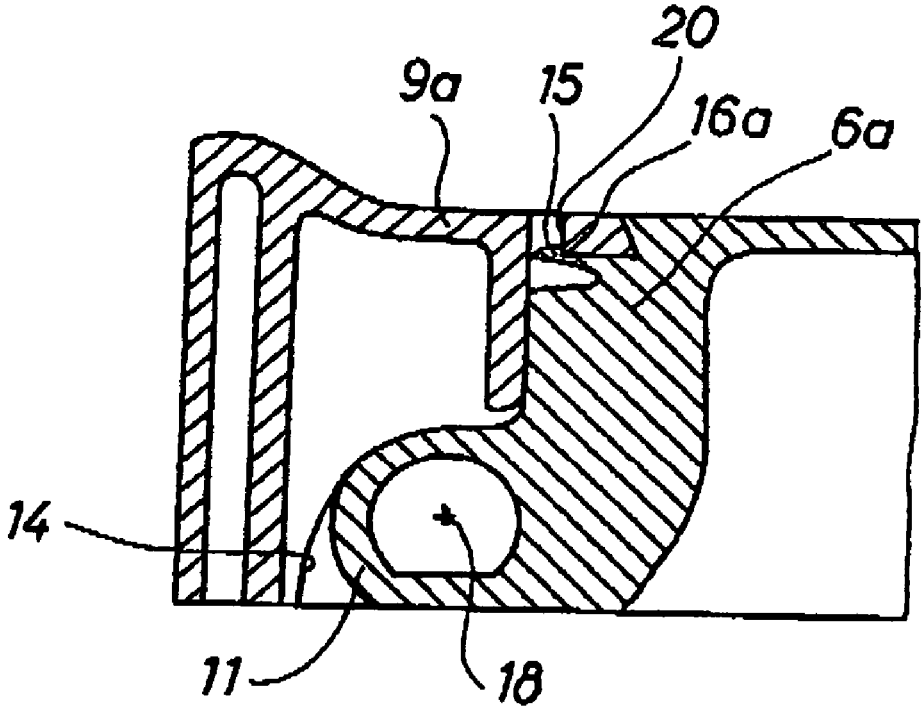
Figure 6:
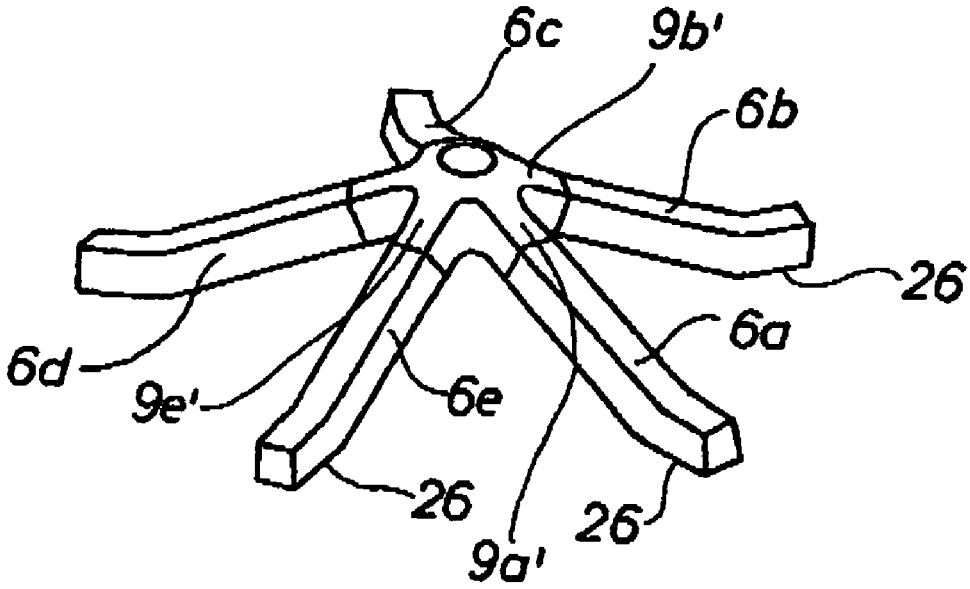
Figure 7:
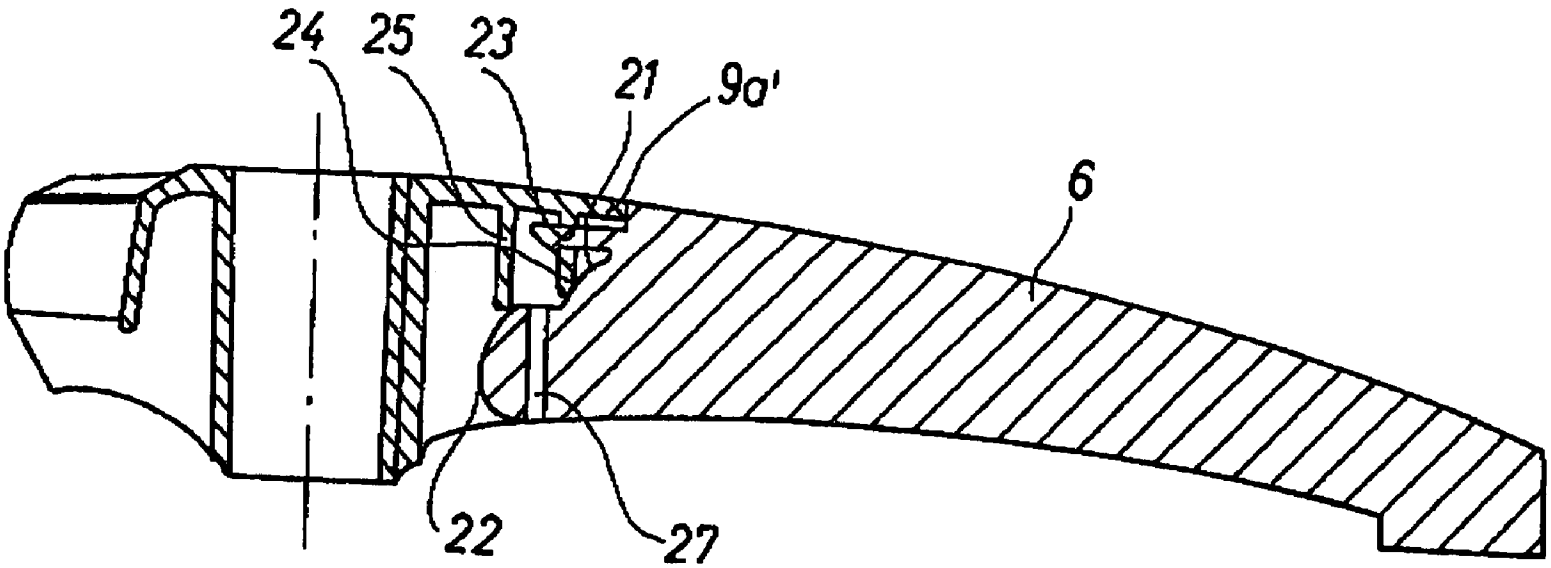

The invention is explained in detail below with reference to the drawings, in which FIG. 1 is a diagrammatic view of the chair according to the invention, FIG. 2 shows an embodiment of a star-shaped member, one end of the aforementioned legs being secured therein, FIG. 3 is a longitudinal sectional view through a projecting portion of the star-shaped member and through one end of the leg to be secured in the star-shaped member, FIG. 4 shows the same members as FIG. 3, the members being assembled, FIG. 5 shows a projecting portion on the star-shaped member, and where a channel is provided in the projecting portion, said channel allowing the locking function of the locking hook to be released, FIG. 6 is a perspective view of a second embodiment of the star-shaped member; the projecting portions of the star-shaped member being bent slightly downwards, and FIG. 7 is a longitudinal sectional view through a third embodiment of the star-shaped member, one end of a leg being inserted in said member; and where the star-shaped member includes an auxiliary rib and a supporting rib positioned in front of said auxiliary rib.

The chair shown in FIG. 1 includes a central, substantially vertical supporting member 1 provided with a seat 2 at the top. A back rest 3 is optionally provided. The supporting member 1 is at the bottom end thereof supported by a plurality of legs 6*a*-6*e*. Each leg 6*a*-6*e* is substantially horizontal, and one end of each leg is inserted into an opening in a plurality of projecting portions in a star-shaped member 9 secured at the bottom of the supporting member 1. One end of each leg 6*a*-6*e*, e.g., 6*a*', is secured in the respective opening 7*a*, cf. FIG. 3, by way of a snap effect.

Usually, only one leg is secured in each projecting portion of the star-shaped member 9.

A rounded guide member 11 can be provided on the end 6*a*' of the leg 6*a* which is to be secured to its respective projecting portion of the star-shaped member 9, said guide member being adapted to engage a recess 14 in said projecting portion, cf. FIG. 3. As it appears, the recess is rounded and preferably positioned in the under side of the projecting portion of the star-shaped member 9.

As shown in FIGS. 3, 4 and 5, a locking hook 15 can be provided at the end of each leg 6*a* to be secured to the supporting member. This locking hook is preferably resilient and adapted to cooperate with a recess 16, cf. FIG. 3, in the projecting portion of the star-shaped member 9.

The guide member 11 of each leg is substantially annular and presents preferably a horizontal axis 18, cf. FIG. 5.

The locking hook 15 can be shaped in various ways. It is preferably shaped so as to correspond to the upper half of a horizontal arrow with a strong shaft, cf. FIG. 3.

An abutment face 15*a* is provided at the back of the locking hook 15, said abutment face being adapted to cooperate with a corresponding abutment face 16*a* on the projecting portion 9*a* of the star-shaped member 9, cf. FIG. 5.

As shown in FIG. 3, the recess 14 in the projecting portion of the star-shaped member can present a portion of an elliptical face.

As shown in FIG. 5, a channel 20 can be provided in the projecting portion of the star-shaped member 9 and opposite the head of the locking hook 15, said channel extending from the outer side of the projecting portion and into the head of the locking hook. In this way, the respective leg, e.g., the leg 6*a*, can be easily released from the opening 7*a* in the projecting portion 9*a*, thereby allowing a user to guide a thin, cylindrical tool downwards through the channel 20 and to press said head of the locking hook 15 away from the channel 20.

As shown in FIG. 6, the projecting portions (e.g., see portions labeled 9*a*', 9*b*', 9*e*') of the star-shaped member 9 can be bent slightly downwards, preferably 10 to 30°. Each leg 6*a*-6*e* can be substantially rectilinear, but can include a horizontally positioned portion with a horizontal supporting face 26 at the distal end thereof (only indicated for the legs 6*a*, 6*b* and 6*e*).

FIG. 7 shows yet another embodiment for securing a leg 6 to its respective projecting portion, e.g. 9*a*, of the star-shaped member 9. As it appears, the leg 6 includes a projecting locking hook which is inserted through an opening 23 in a substantially vertically positioned auxiliary rib in the projecting portion 9*a* such that the head of the locking hook is secured at the edge of the opening. The leg 6 is shown with two supporting faces 21 and 22, the supporting face 21 abutting the lower end of the auxiliary rib 24 and the supporting face 22 abutting the supporting rib 25 when the leg is mounted.

FIG. 7 also shows how it is possible to provide an auxiliary channel 27 through for instance the area of the supporting face 22, said auxiliary channel 27 allowing for guiding a thin, cylindrical tool through said channel so as to abut the head of the locking hook 15. As a result, the head can be pressed free of the opening 23 and the leg 6 can be released from the projecting portion 9*a*.

The invention can be varied in many ways without deviating from the scope of the present invention.

The invention claimed is:

1. A chair including a central, substantially vertical supporting member provided with a seat at the top thereof, where said supporting member at the bottom end thereof or adjacent thereto is supported by a plurality of legs, characterised in that each leg is substantially horizontal, and that one end of each leg is inserted into an opening in a projecting portion of a star-shaped member positioned at the bottom end of the supporting member, said one end of each leg being secured in the opening by way of a snap effect and wherein each leg is secured to its respective projecting portion of the star-shaped member by a projecting, rounded guide member positioned at one end of said leg, said guide member being adapted to engage a recess in the under side of the projecting portion of the star-shaped member.

2. A chair according to claim 1 further comprising a back rest.

3. A chair according to claim 1 wherein said recess is rounded.

4. A chair according to claim 1, characterised in that the rounded guide member of each leg is substantially annular.

5. A chair according to claim 4 wherein the guide member of each leg presents a horizontal axis.

6. A chair including a central, substantially vertical supporting member provided with a seat at the top thereof, where said supporting member at the bottom end thereof or adjacent thereto is supported by a plurality of legs, characterised in that each leg is substantially horizontal, and that one end of each leg is inserted into an opening in a projecting portion of a star-shaped member positioned at the bottom end of the supporting member, said one end of each leg being secured in the opening by way of a snap effect and wherein a locking hook is provided at the end of each leg to be secured to the star-shaped member, said locking hook being adapted to cooperate with a second recess in the projecting portion of the star-shaped member.

7. A chair according to claim 6, characterised in that the locking hook is shaped so as to correspond to an upper half of a horizontal arrow with a shaft.

8. A chair according to claim 6, characterised in that a channel is provided in the projecting portion of the star-shaped member and opposite a head of the locking hook, said channel extending from the outer side of the projecting portion and to the head of the locking hook.

9. A chair according to claim 6, characterised in that an abutment face is provided at the back of the locking hook, said abutment face being adapted to cooperate with a corresponding abutment face on the projecting portion of the star-shaped member.

10. A chair according to claim 6 wherein said locking hook is resilient.

11. A chair according to claim 6, characterised in that an auxiliary channel is provided in a portion of the leg whereupon at least one of the supporting faces is provided, said auxiliary channel extending from the outer side of the leg and to a position in the vicinity of a head of the locking hook.

12. A chair according to claim 6 further comprising a back rest.

13. A chair according to claim 6, characterised in that each leg is secured to its respective projecting portion of the star-shaped member by inserting a head of the locking hook through an opening in a substantially vertically positioned auxiliary rib in said projecting portion, and that the leg includes two supporting faces.

14. A chair according to claim 13 wherein the supporting faces are integrally formed and abutting the lower and of the auxiliary rib and a supporting rib positioned in front of said auxiliary rib, respectively.

15. A chair including a central, substantially vertical supporting member provided with a seat at the top thereof, where said supporting member at the bottom end thereof or adjacent thereto is supported by a plurality of legs, characterised in that each leg is substantially horizontal, and that one end of each leg is inserted into an opening in a projecting portion of a star-shaped member positioned at the bottom end of the supporting member, said one end of each leg being secured in the opening by way of a snap effect and wherein a recess in the projecting portion of the star-shaped member presents a portion of an elliptical face.

16. A chair according to claim 15 further comprising a back rest.

* * * * *